United States Patent [19]

Agrawal

[11] Patent Number: 4,516,419

[45] Date of Patent: May 14, 1985

[54] METHODS OF ENHANCING SUPERPLASTIC FORMABILITY OF ALUMINUM ALLOYS BY ALLEVIATING CAVITATION

[75] Inventor: Suphal P. Agrawal, Rancho Palos Verdes, Calif.

[73] Assignee: Northrop Corporation, Hawthorne, Calif.

[21] Appl. No.: 335,264

[22] Filed: Dec. 28, 1981

[51] Int. Cl.[3] ..... B21D 26/04

[52] U.S. Cl. ..... 72/60; 72/342; 72/364

[58] Field of Search ..... 72/342, 364, 60

[56] References Cited

U.S. PATENT DOCUMENTS 4,352,280 10/1982 Ghosh ..... 72/60

4,354,369 10/1982 Hamilton ..... 72/60

4,381,657 5/1983 Hamilton et al. ..... 72/342

*Primary Examiner*—Leon Gilden

*Attorney, Agent, or Firm*—John E. Peele, Jr.; Robert J. Stern

[57] ABSTRACT

Disclosed is a method of forming metallic materials exhibiting the phenomenon of superplasticity, particularly high strength aluminum alloys, by the technique of superplastic forming by focing an alloy blank into a die cavity using opposing fluid pressures, the pressure on the die side of the blank initially balancing the pressure on the opposite blank side, the die side pressure being reduced as the other pressure is maintained constant or increased to deform the blank at a combined high pressure whereby precision molding occurs as the blank engages the die intimately and cavitation in the blank is reduced or alleviated.

4 Claims, 6 Drawing Figures

METHODS OF ENHANCING SUPERPLASTIC FORMABILITY OF ALUMINUM ALLOYS BY ALLEVIATING CAVITATION

FIELD OF THE INVENTION

This invention relates to forming metallic materials, and particularly to an improved method of superplastically forming parts of metal such that the surface in contact with a die is in intimate engagement with all portions thereof.

BACKGROUND OF THE INVENTION

Superplastic forming is one of the most important technologies to emerge in recent years. This technology uses a phenomenon called superplasticity which occurs in several metals under well-defined conditions of microstructure, temperature, and strain rate. The most important characteristic of superplastically formable materials is their exceptional stability in uniaxial tensile deformation. This enables extremely large delongations, usually greater than 200 percent without fracture; whereas, for conventional materials the equivalent values are usually less than 50 percent. Since the potential for large elongations in several structural metals, primarily titanium alloys, was first demonstrated, the superplastic forming of such alloys has been systematically developed into a technology for manufacturing parts on a production basis.

Forming methods employing the principle of superplastic metal forming use fluid pressure to cause sheet material deformation into a die complementary to the part to be formed. Several methods have been described for superplastically forming parts using various techniques with fluid pressure whereby the pressure is generated by gas under pressure on one side of the sheet. The opposite side of the sheet is maintained either under atmospheric pressure, or sometimes a vacuum is generated on this side. As the pressure increases and/or the vacuum increases, the sheet is deformed into substantial engagement with the surface of the die. However, many reject parts result due to partial destruction of the part caused by cracks being formed as the strain rate exceeds the critical range permissible, thereby resulting in the loss of superplasticity in the sheet and permitting rupturing caused by concentrating all subsequent sheet deformation in one or more local areas. Also, many rejects occur due to incomplete forming of the component relative to the die cavity.

BRIEF SUMMARY OF THE INVENTION

Two specific goals of the novel method of the present invention are to enhance tensile elongation of the metallic material during the forming process thereby enhancing their superplastic formability thereof, and to enable the resulting component to be formed with a more uniform thickness profile. The method is implemented by application of fluid pressure on both sides of the blank being superplastically formed. The opposing pressures suppress or eliminate "cavitation" thereby reducing the chances of rupturing of the component. The maintenance of the uniform thickness of the component is accomplished without any additional friction-reducing coatings on either the component blank or the die. Rather, this is accomplished by creating between the deforming sheet and the die member at least a thin fluid layer, acting as a lubricant, until the forming is nearly complete.

When certain metallic alloys, particularly some of the structural aluminum alloys, are superplastically formed, cavitation is observed during such deformation. Cavitation is a phenomenon which generally arises under the combined action of tensile stress and grain-boundary sliding of the grains in the material. Both of these conditions exist during the superplastic forming process. In its simplest form, when one grain slides past another grain during the forming process, a cavity may be generated along the boundary therebetween as the grain shifts relative to the other adjacent grains, unless an accommodation event occurs forcing the same or another grain, or a part thereof, to close the cavity. Although triple-grain junctions or triple points are the usual sites for cavities, such cavities may also be observed at other locations on the grain boundaries in superplastically deformed material.

Cavitation places a limitation on allowable (superplastic) deformation and the final properties of components formed by the superplastic forming process. Elimination or a substantial reduction of cavities is essential to enhance tensile elongation during the process, thereby enhancing the superplastic formability of some materials such as aluminum alloys, and to ensure the desirable properties in the product so formed.

This novel method of the present invention is implemented during the superplastic forming process cycle by application of equal high fluid pressure on both sides of the sheet or blank to be superplastically formed after heating the die and the sheet to a stable forming temperature. The pressure from the die cavity is then vented, as a function of time, to exert a predetermined pressure-time forming cycle depending upon the material, the forming temperature, the thickness of the sheet, and other characteristics of the component. Upon completion of the forming cycle, all the gas/fluid pressure is vented out from the die cavity side and high gas/fluid pressure is maintained on the formed sheet to completely conform the sheet to the die surface.

The use of the gas/fluid pressure in the die cavity, high in the beginning of the forming cycle and decreasing with the progression of forming, provides a compressive stress over the entire sheet to suppress initiation of cavities and to effect closure or reduction of most cavities generated in the blank during forming. The high pressure maintained on the blank, on the side opposite the die, after completion of the forming also provides a similar compressive stress over the entire sheet to effect closure or reduction of most cavities generated therein and still remaining. Further, the presence of a thin layer of gas fluid between the metallic sheet and the die member (until nearly the very end of the forming operation) provides a "cushion" and serves to distribute the thickness of the blank during forming much more uniformly than obtained with conventional friction-reducing coatings alone.

STATEMENT OF THE PRIOR ART

U.S. Pat. No. 4,269,053, Angrawal et al., described an improvement in a method of making a component by superplastic forming, including providing a release coating to reduce the coefficient of friction between the component blank and the forming member. This patent adds additional steps to an already complex method.

U.S. Pat. No. 3,934,441, Hamilton et al., discloses forming a component between compressive forces of a forming member and tensile forces of fluid pressure applied to the blank.

U.S. Pat. No. 3,769,834, Granzow, discloses a method of forming a blank of aluminum essentially at room temperature by a punch which drives the material into the die cavity. Generally, such operations require multiple steps and dies to cause complete forming of the component to any more than the most gentle radii or detail.

None of the prior art of which applicant is aware obtains the intimate contact of the component blank against the die cavity while reducing cavitation.

An object of the invention is to provide an improved superplastic forming process.

Another object of the invention is to provide a novel method for superplastically forming parts with minimum cavitation.

A further object of the invention is to provide a novel method for superplastically forming parts with improved uniformity of thinning.

Yet another object of the invention is to provide a method for superplastically forming parts with a single forming operation.

Still another object of the invention is to provide a method for superplastically forming parts with intimate engagement of the part with the forming die.

Further and other objects will be apparent from the description of the accompanying drawings in which like numerals refer to like parts.

The present invention describes a method by which components can be superplastically formed of a metallic alloy exhibiting the superplasticity phenomenon, such as high strength aluminum alloys, and by which cavities in the alloy can be healed or prevented during such superplastic forming process. When aluminum alloys are superplastically formed by existing processes, evidence of cavitation near grain boundaries and triple point junctions can be observed. The combined action of tensile stress and grain-boundary sliding, both of which exist during superplastic elongation of a metallic material, is generally responsible for such cavitation. In components formed of aluminum alloy sheet, resulting cavities reduce structural integrity and other properties such as fatigue life. To restore these properties in the material, it is essential to heat these cavities or, preferably, to prevent formation thereof. Thus, the invention relates to a method of alleviating cavity formation and growth by the use of a compressive stress during the superplastic forming process. Because of the two types of fluid/gas stresses applied to the blank being formed, namely, a normally applied tensile stress and an additionally applied compressive stress, this technique is referred to as "dual-pressure technique".

In summary, this invention relates to the precision forming of components of metallic alloys which have characteristics enabling them to superplastically form. By this dual-pressure technique, the resulting component is formed by forcing the alloy sheet or blank into intimate contact with the configuring die, while simultaneously reducing or alleviating cavities which tend to form in the structure. The process permits the metallic alloy to reach significantly high strain values before rupturing; these values are generally much higher than would be possible without this method. Thus, the superplastic characteristics are improved over the characteristics of comparable alloy materials manufactured under existing methods.

Figure 1:
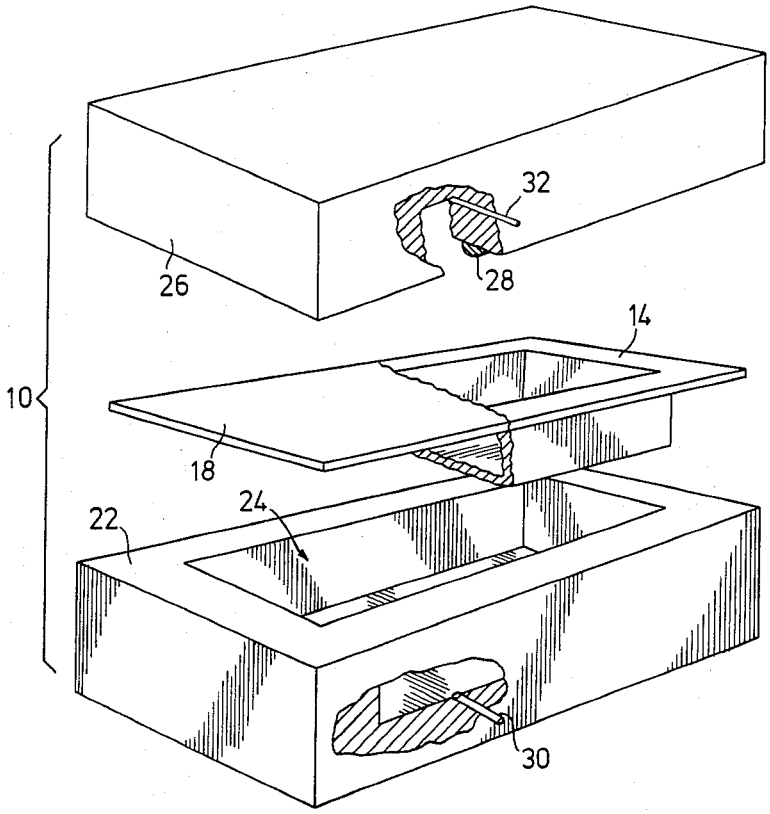
FIG. 1 is a schematic view of an apparatus for enabling performing of the method described herein, including parts in section for clarity, and including representation of a blank and a resulting component.
Figure 2:
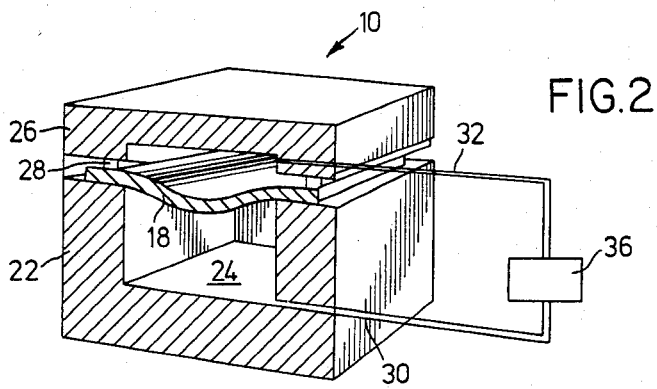
FIG. 2 is an elevational schematic view of an apparatus including a blank after the forming cycle has started.

Referring to FIG. 1, disclosed is an assembly 10 for forming of a component 14 from a sheet or blank 18 of a metallic alloy material, preferably an aluminum alloy. Assembly 10 includes a die 22 having a cavity 24 configured complementary to the desired configuration of the cavity engaging surface of component 14. Opposite the die cavity, a sealable lid or cover 26 is provided having a seal 28 about the periphery thereof for enclosing the fluid in the effective cavity area of the assembly about the sheet 18.

Die 22 and cover 26 are provided with small orifices or ports 30, 32 to enable the inflow and outflow of fluid, such as air or an inert gas, supplied under pressure from an external source by control means, represented at 36. The die 22 and the cover 26 are capable of being heated to a temperature at which the alloy blank 18 exhibits superplastic properties. After the temperature of the sheet stabilizes, fluid pressure is applied to the blank through the ports 30, 32, as described hereafter, to cause the blank 18 to be deformed against the cavity surface of die 22.

To obtain the desired intimate contact of the blank 18 against the die 22, the gas supplied under pressure through ports 30 and 32 is controlled respectively. Certain pressure values are selected at different times during the component forming cycle to control the tensile stress on the blank, and to provide compressive forces to operate against formation and growth of voids or cavities in the structure of the blank as forming takes place. These opposing forces cause relatively uniform thinning of the blank as well as alleviation of cavitation. The pressure applied from the port 32 above the blank to force the blank against the die is selected with substantially known unit values such as an initial pressure typically in the range of 200–800 pounds per square inch (psi).

Figure 3:
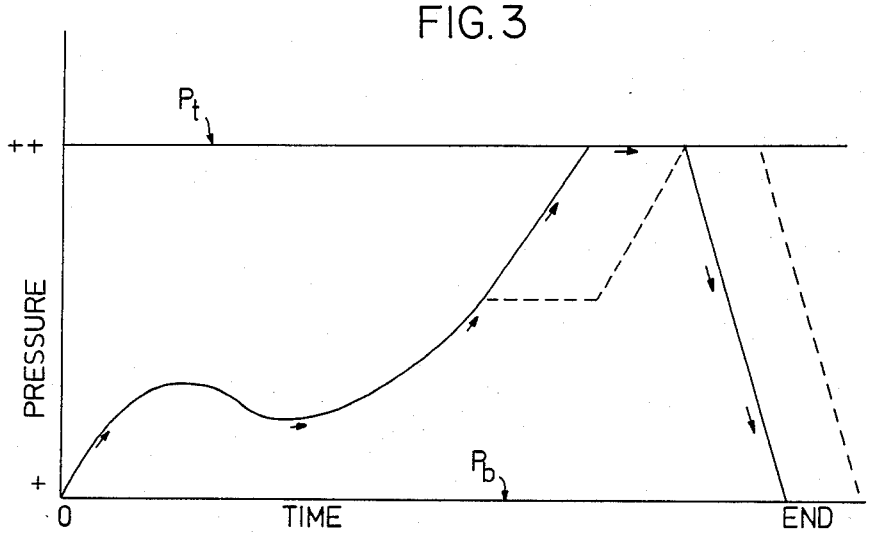
FIG. 3 is a pressure vs. time profile of the pressure applied to the blank during the prior art forming cycle.

During the forming cycle of existing methods, the pressure on the cover side is increased or decreased with time, or held constant, as shown in FIG. 3; the maximum pressure reached is $P_f$. The pressure on the cavity side is either kept at zero or a low positive value. The dashed line in FIG. 3 represents an alternate cycle pattern in which the pressure is held constant for a period of time to enable "relaxing" of the blank prior to and after final deformation to the configuration of the component.

In the method according to this invention, at the beginning of the forming cycle, the pressures on both the cavity side and the cover side are increased to a high value $P_f$. The pressure on the cover side is maintained at or near this value, during a portion of the forming cycle, and is then reduced to zero or a low positive value, as represented by the line OABE in FIG. 4. The pressure on the opposite side of the blank, input through port 30, is controlled, i.e., decreased, increased or held constant, as shown by the line OACDFTE in FIG. 4. The dashed line in this figure represents an alternate cycle pattern in which the pressure is held constant for a period of time to enable "relaxing" of the blank prior to and after final deformation to the configuration of the component, similar to that described in FIG. 3.

Thus, in the method of the invention, as the forming cycle begins, the pressure 30 is brought to a balance with the pressure 32 at a value of $P_t$. Thereafter, the pressure through port 30 is reduced, increased or held constant, as shown by line OACDFTE in FIG. 4, while the pressure through port 32 is maintained at value $P_t$, or near it, thus exerting a net pressure of $P_t - P_b$ on the blank 18. The relatively high values of Pressure $P_b$ cause compression forces to be applied on the blank from the beginning of the deformation.

Figure 5:
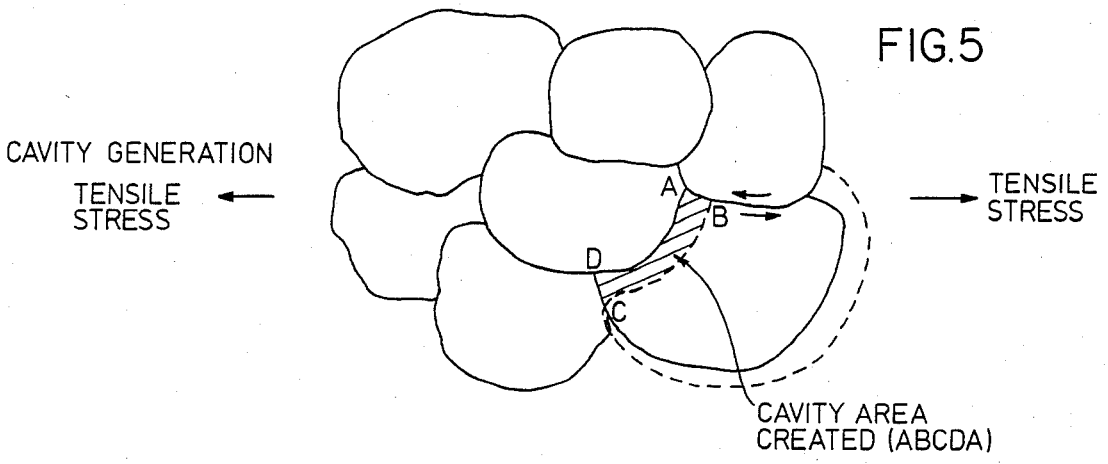
FIG. 5 is a schematic representation of several grains of alloy being superplastically formed with tensile forces, but without a compressive force.
Figure 6:
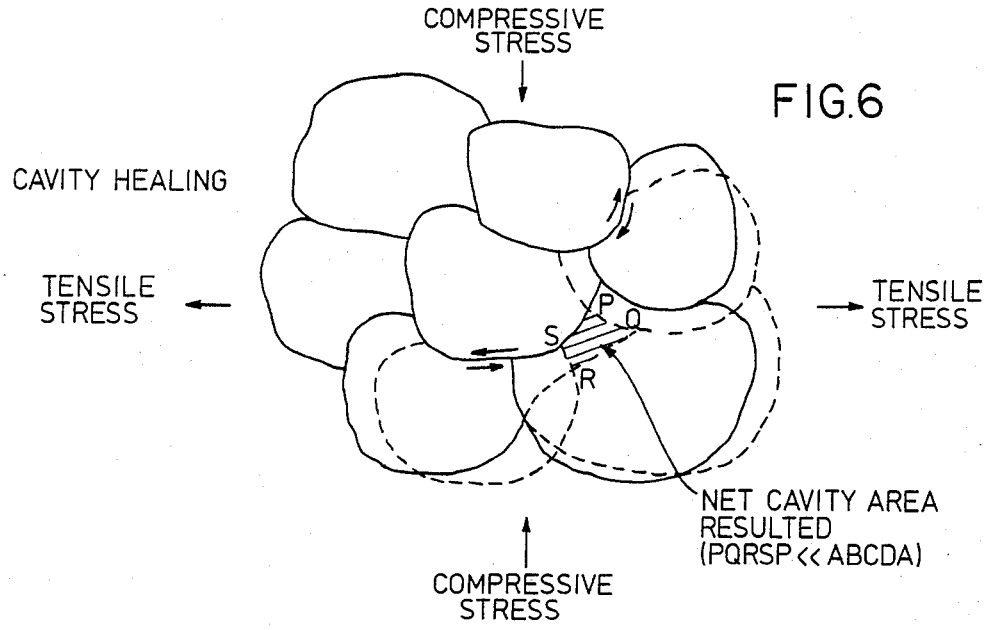
FIG. 6 is a schematic representation of the grains of FIG. 5 with displacement due to a compressive force in addition to the tensile force.

The advantage of the presence of such a compressive force is illustrated in FIGS. 5 and 6. FIG. 5 shows the initiation (called nucleation) of forming of a cavity or a void ABCDA between grains during the superplastic deformation under the combined action of tensile stress and grain-boundary sliding. FIG. 6 shows the reduction of cavity ABCDA to a much smaller cavity PQRSP with the aid of an added compressive stress. With proper combination of fluid/gas pressure, forming rate and temperature, cavity PQRSP can be reduced to zero or a near-zero area.

Figure 4:
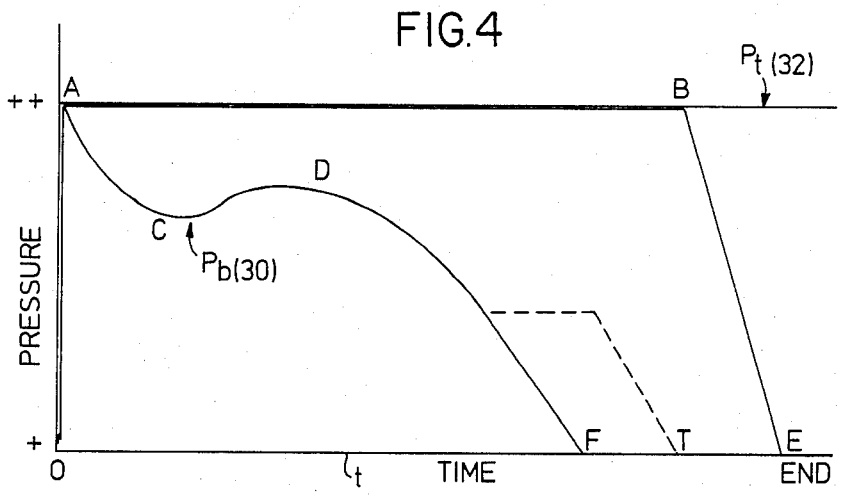
FIG. 4 is a pressure vs. time profile of the pressures applied to the cover side and die cavity side of the apparatus during a forming cycle.

As is apparent from the pressure-time profile in FIG. 4, the pressure 30 is reduced gradually during the forming cycle until it is permitted to reach "zero", while the pressure 32 is held at the maximum value. Such pressure-time profiles are representative of the typical reversals and/or plateaus which are selected according to factors including the alloy and temperature used, the forming rate, the thickness of the blank, the degree of deformation desired, the geometry of the component, and the thickness of the final sections of the component.

In summary, the method of the present invention includes the steps of positioning a blank 18 over a die cavity 24 of an assembly 10, in which the blank can be heated sufficiently to be superplastically deformable. Forming of the blank 18 occurs as fluid pressure is provided simultaneously against both surfaces of the blank, with the pressure above the blank from port 32 being increased to the maximum in the beginning and held at that value or near it, until the end of forming. The pressure on the die cavity surface of the blank from port 30 is maintained initially at a relatively high pressure (equal to the maximum pressure through port 32) and then is reduced at predetermined rates. The blank 18 consequently forms due to the net differential pressure (difference of pressure through ports 32 and 30, respectively) into the cavity 24 of die 22. Due to the application of sufficiently high net pressure on the blank, the superplastic forming deformation occurs with the blank being forced into intimate contact with the cavity surface of the die. The blank is thereby formed with high precision into a component having reproduced thereon all detail of the die cavity surface. Simultaneously, due to the compressive forces applied to the blank during forming, any cavities which might have started to form will have been healed or alleviated, and the incidence of rupture of the blank is reduced or prevented.

It is to be understood that the embodiment shown is illustrative of the primary method of forming a blank using the principle of applying dual pressure to the blank during a superplastic forming process. Certain changes, alterations, modifications, or substitutions can be made in the method and the apparatus used therewith without departing from the spirit and scope of the invention.

I claim:

1. Improvements in a method of superplastically forming a component by deformation comprising the steps of:

providing a blank of material having superplastic characteristics to be deformed into the component;

providing a die having a cavity surface which is complementary to the shape of the component, and having fluid ports;

providing a die opposing cover having fluid ports;

providing a fluid supply for introducing fluid under pressure controllably through said fluid ports of said die and said cover;

positioning said blank between said die and said cover;

bringing said blank to a temperature at which said blank exhibits superplastic characteristics;

applying to the blank a first fluid pressure on the cavity side thereof; and simultaneously applying to said blank a second fluid pressure to the cover side thereof;

the improvement comprising controlling said first and second fluid pressures as applied to said blank during a forming cycle to generate opposing forces to apply initially a very low or substantially nil pressure differential causing compressive force to opposing sides of said blank and then to reduce the cavity side pressure to permit said blank to be forced toward engagement with said die, and thereafter varying said cavity side pressure as a function of time while maintaining constant the cover side pressure in order to create a net differential pressure in accordance with the predetermined pressure-time requirements as necessary to form the blank into the said component shape, and reducing said pressures at substantially the same rate or reducing said cavity side pressure at a rate slightly lower than the rate of decrease of the cover side pressure whereby the differential pressure reduces gradually until said pressures are eliminated and said blank is caused to fully engage said die.

2. The method of claim 1 wherein said compressive fluid pressures exceed 200 psi.

3. The method of claim 2 wherein said fluid causing said pressures is compressed gas.

4. The method of claim 2 wherein the second pressure is initially in a range of 200 to 800 psi, and is reduced to "zero" at the end of the forming cycle.

* * * * *